US007604516B2

(12) United States Patent
Adunka et al.

(10) Patent No.: US 7,604,516 B2
(45) Date of Patent: Oct. 20, 2009

(54) POWER FEEDING MODULE

(75) Inventors: Robert Adunka, Sulzbach-Rosenberg (DE); Berthold Heldmann, Freudenberg (DE)

(73) Assignee: Siemens Aktiengesellschaft, Munich (DE)

( * ) Notice: Subject to any disclaimer, the term of this patent is extended or adjusted under 35 U.S.C. 154(b) by 75 days.

(21) Appl. No.: 11/662,082

(22) PCT Filed: Sep. 2, 2005

(86) PCT No.: PCT/EP2005/054332

§ 371 (c)(1),
(2), (4) Date: Jan. 28, 2008

(87) PCT Pub. No.: WO2006/027338

PCT Pub. Date: Mar. 16, 2006

(65) Prior Publication Data

US 2008/0160838 A1 Jul. 3, 2008

(30) Foreign Application Priority Data

Sep. 8, 2004 (DE) ..... 10 2004 043 467

(51) Int. Cl.
*H01R 9/22* (2006.01)

(52) U.S. Cl. ..... 439/709; 439/512; 439/715; 439/810

(58) Field of Classification Search ..... 439/512, 439/709, 715, 810; 361/675
See application file for complete search history.

(56) References Cited

U.S. PATENT DOCUMENTS 5,144,530 A 9/1992 Cohen et al.
5,269,710 A * 12/1993 Donnerstag ..... 439/810
6,663,441 B1 12/2003 Alexandre et al.
6,733,347 B2 * 5/2004 Palet Mercader et al. ... 439/810
7,173,809 B2 * 2/2007 Bauer et al. ..... 361/611

FOREIGN PATENT DOCUMENTS

| | | |
|---|---|---|
| DE | 38 13 099 | 11/1989 |
| DE | 38 13 099 A1 | 11/1989 |
| DE | 44 02 001 | 7/1995 |
| DE | 195 15 923 | 11/1996 |
| DE | 195 15 923 A1 | 11/1996 |
| DE | 199 02 745 | 8/2000 |
| DE | 101 56 214 | 6/2003 |
| DE | 101 56 214 A1 | 6/2003 |
| EP | 0 112 232 | 6/1984 |
| EP | 0 112 232 A1 | 6/1984 |
| EP | 0 454 016 | 10/1991 |
| EP | 0 454 016 A1 | 10/1991 |
| EP | 1 351 336 A1 | 3/2002 |

OTHER PUBLICATIONS

German Office Action dated May 11, 2005.
German Office Action dated Jul. 26, 2006.
PCT/ISA/210.

* cited by examiner

*Primary Examiner*—Tho D Ta
(74) *Attorney, Agent, or Firm*—Harness, Dickey & Pierce, P.L.C.

(57) ABSTRACT

Disclosed is a power feeding module including screw-clamping terminals for delivering power and push-lock terminals. The power feeding module is particularly easy to assemble and wire with a power distribution system to which several consumer branches can be connected.

19 Claims, 3 Drawing Sheets

POWER FEEDING MODULE

PRIORITY STATEMENT

This application is the national phase under 35 U.S.C. §371 of PCT International Application No. PCT/EP2005/054332 which has an International filing date of Sep. 2, 2005, which designated the United States of America and which claims priority on German Patent Application number 10 2004 043 467.0 filed Sep. 8, 2004, the entire contents of which are hereby incorporated herein by reference.

FIELD

Embodiments of the invention generally relate to a polyphase, encapsulated electrical-power feed module. For example, it may relate to one having a housing which has, in its interior, connecting terminals which are electrically connected to first plug connections which are used to make electrical contact with a polyphase power distribution system.

BACKGROUND

An electrical-power feed module is disclosed in EP 1 351 336. The plug module disclosed here has box terminals and a lyre contact which is electrically connected to each box terminal. The lyre contacts are plugged on to a busbar of a polyphase system for electrical connection. A cover must be removed from the electrical-power feed module in order to connect the electrical conductors to the box terminals, and this ensures protection against direct contact in the assembled state. The electrical plug connection of the lyre contacts to the busbars necessitates the assembly process being carried out together with a dielectric mount, which is used as a holder, for the electrical-power feed module.

Polyphase, encapsulated electrical-power feed modules are known from DE 101 56 214 A1 and EP 0 112 232 A1.

SUMMARY

At least one embodiment of the invention is directed to a polyphase, encapsulated electrical-power feed module, which allows particularly simple assembly and wiring. In addition, if the screw connecting terminals are electrically connected to second plug connections which are located in the interior of the housing and are accessible via a second contact-making opening in the housing, this provides a further option for connection to a power distribution system.

In at least one embodiment, a jumper plug is provided in order to make electrical contact and is matched to the first plug connections, and by which the first plug connections can be electrically connected to the polyphase power distribution system. Further, the connecting terminals each have a first associated conductor insertion opening in the housing, and the housing is provided with at least one attachment device for attachment of the electrical-power feed module.

In at least one embodiment, the following three functions are carried out independently of one another:

- mechanical attachment of the electrical-power feed module,
- electrical connection of the feed line,
- and electrical connection of the electrical-power feed module to the power distribution system.

One particularly simple embodiment is for the connecting terminal to be in the form of a screw connecting terminal, which has an associated access opening to the connecting screw in the housing.

If the first plug connections are located in the interior of the housing and are accessible via a first contact-making opening in the housing, this allows protection against direct contact to be ensured in a simple manner. This is advantageously achieved by the jumper plug being matched to the first contact-making opening in such a manner that the first contact-making opening is closed by the jumper plug after contact has been made with the first plug connections.

The screw connecting terminals are advantageously in the form of box terminals.

The first and/or second plug connections are advantageously in the form of busbar sections, which allow simple plug connection.

If the jumper plug has lyre contacts, this allows the connection to be made with the busbars particularly easily. In order to prevent shorts between the busbar sections, the busbar sections are separated from one another by insulating separating walls.

A further advantageous embodiment of the invention is for the electrical-power feed module to be electrically connected by way of the jumper plug to a power distribution system once it has been permanently installed via its at least one attachment device, and for it to be possible to disconnect this electrical connection only by removal of the jumper plug. Specifically, this allows an embodiment in which the open isolation gap to the contacts of the power distribution system can be seen once the jumper plug has been removed.

A further advantage in at least one embodiment, is for the power distribution system to be accommodated in a mount to which at least one switching device, which is connected to the power distribution system, is adapted. If the fitter requires access to the switching device, then he just needs to withdraw the jumper plug and can then safely access the disconnected switching device, because the isolation gap can be seen to be open.

BRIEF DESCRIPTION OF THE DRAWINGS

One example embodiment of the invention will be explained in more detail in the following text with reference to a drawings, in which.

DETAILED DESCRIPTION OF THE EXAMPLE EMBODIMENTS

Figure 1:
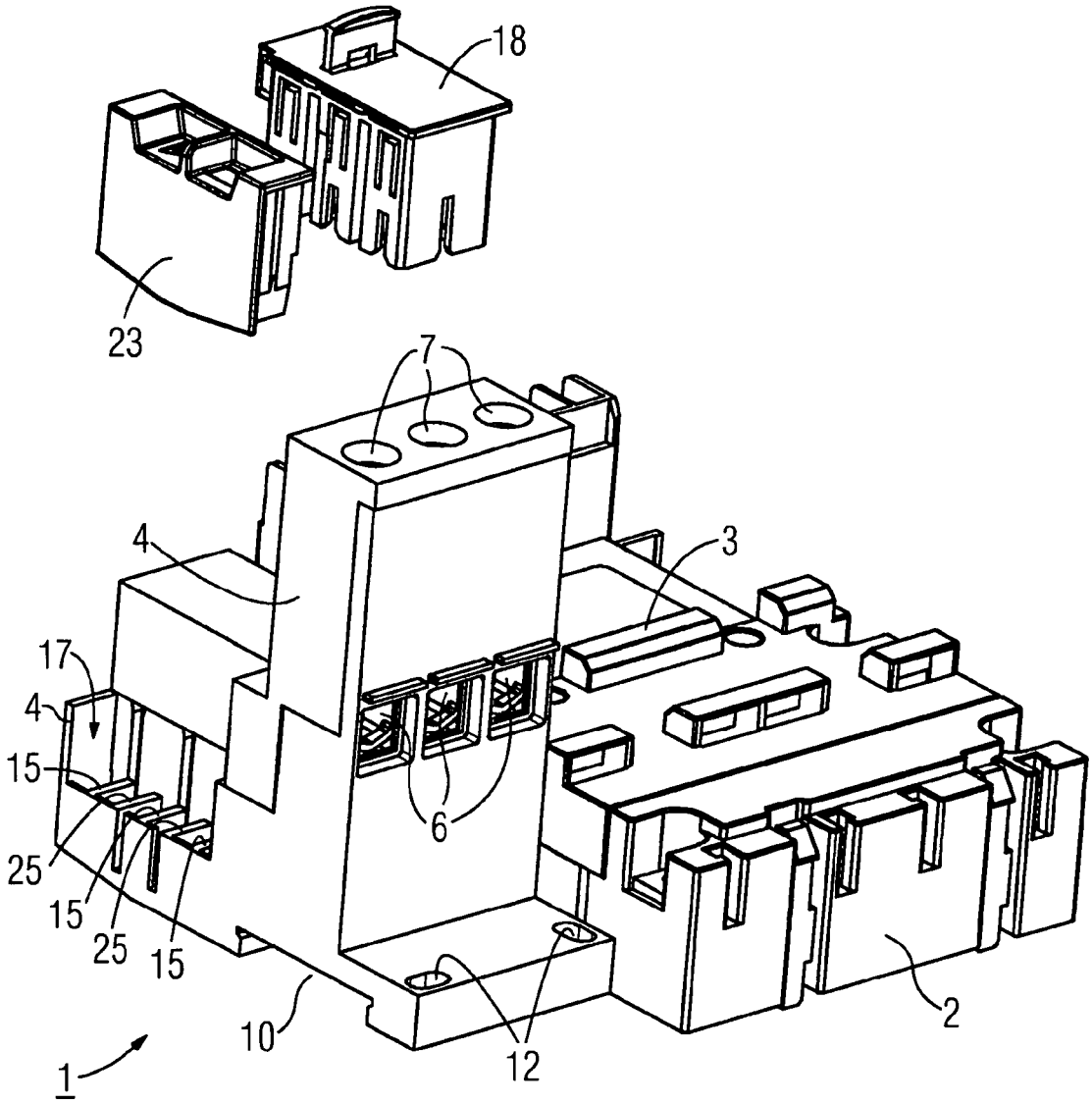
FIG. 1 shows a perspective view of an electrical-power feed module according to an embodiment of the invention, using screw connection technology, with an associated bus plug.

FIG. 1 shows a perspective view of a polyphase, encapsulated electrical-power feed module 1 according to an embodiment of the invention for use in low-voltage switchgear technology, which is used on the one hand for connection to and for making contact with the feed lines and to pass on the current to a polyphase power distribution system, which can be coupled electrically. The loads are connected via switching devices from the power distribution system, which is normally in the form of a busbar system.

A mount 2 in which a busbar system (which cannot be seen here) is accommodated and which has at least one attachment device 3 for mechanical adaptation of switching devices is arranged alongside the electrical-power feed module 1.

Figure 2:
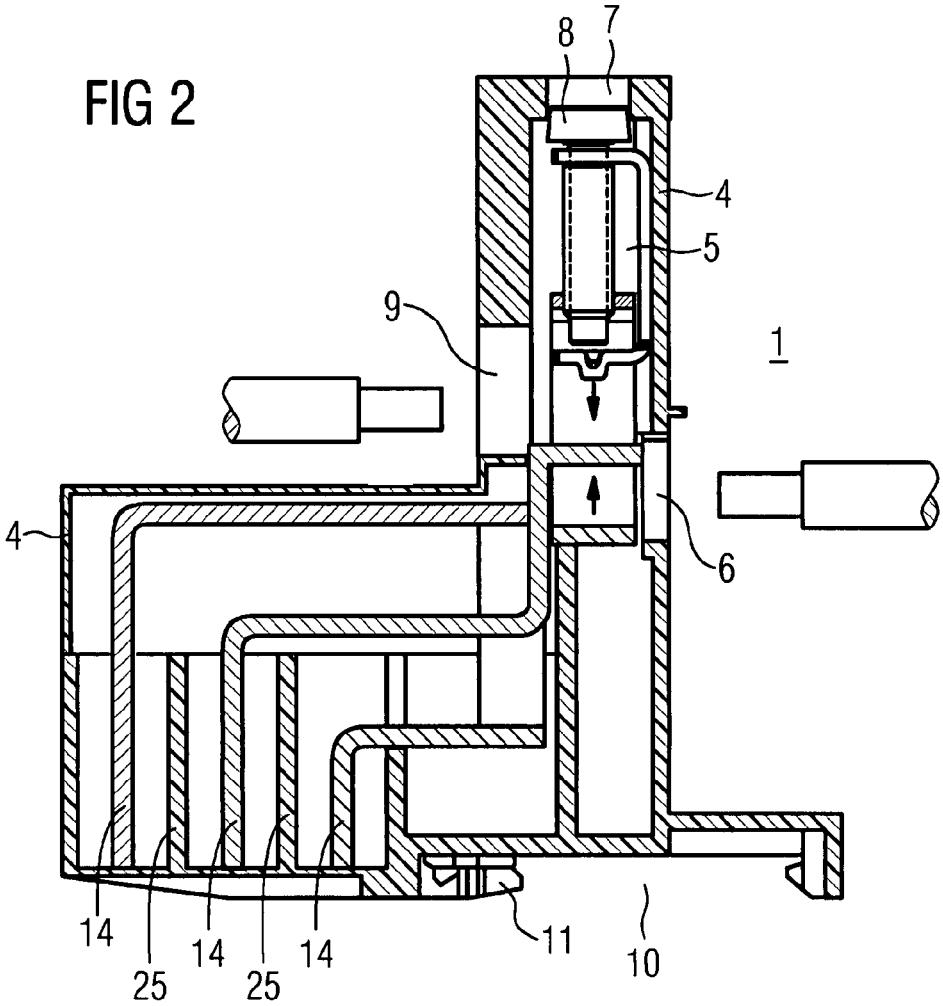
FIG. 2 shows a section illustration through the electrical-power feed module as shown in FIG. 1.

The electrical-power feed module shown in FIGS. 1 and 2 is a three-phase device with a housing 4 in whose interior three screw connecting terminals, which are in the form of box terminals 5, are located. In principle it should be noted that is also possible to use different screw connecting terminals, or entirely different connecting terminals.

The housing 4 of the electrical-power feed module 1 in each case has at least one first conductor insertion opening 6 and an access opening 7 to the connecting screw 8 for each screw connecting terminal 5, as can also be seen from the section illustration of the electrical-power feed module 1 shown in FIG. 2. The first conductor insertion openings 6 are located on one side of the housing 4. In order to allow feed lines to be electrically coupled on both sides, two conductor insertion openings 9 are provided, as shown in FIG. 2, on the opposite side, via which a feed line can be inserted for connection to the screw connecting terminal 5.

On its attachment side, the housing 4 is in the form of a cap and has a cutout 10 with associated top-hat rail attachment device(s) 11 for snapping onto a top-hat rail. Recesses, for example drilled holes 12, are provided on the cap-like shape of the housing 4, for alternative attachment. The access openings 7 in the housing 4 to the connecting screws 8 of the box terminals 5 are located on the front face, opposite the attachment face and facing the fitter once the electrical-power feed module 1 has been fitted. In this fitted state, the first and second conductor insertion openings 6 and 9, respectively, are accessible from above and from underneath and allow convenient coupling at the top or bottom, depending on the position of the feed lines.

This embodiment also makes it possible to simultaneously connect a line to the screw connecting terminal 5 from above and from underneath, with one of the two lines being used as a feed line, and the other being used to pass on the power.

FIG. 2 shows that the first and second conductor insertion openings 6, 9 are not aligned, but that a separating rear wall of the housing 4 is located opposite each conductor insertion opening 6, 9, ensuring the function of insulation of an inserted feed conductor from the outside, and also allowing rapid wiring, as a stop, during insertion of the feed line.

Figure 4:
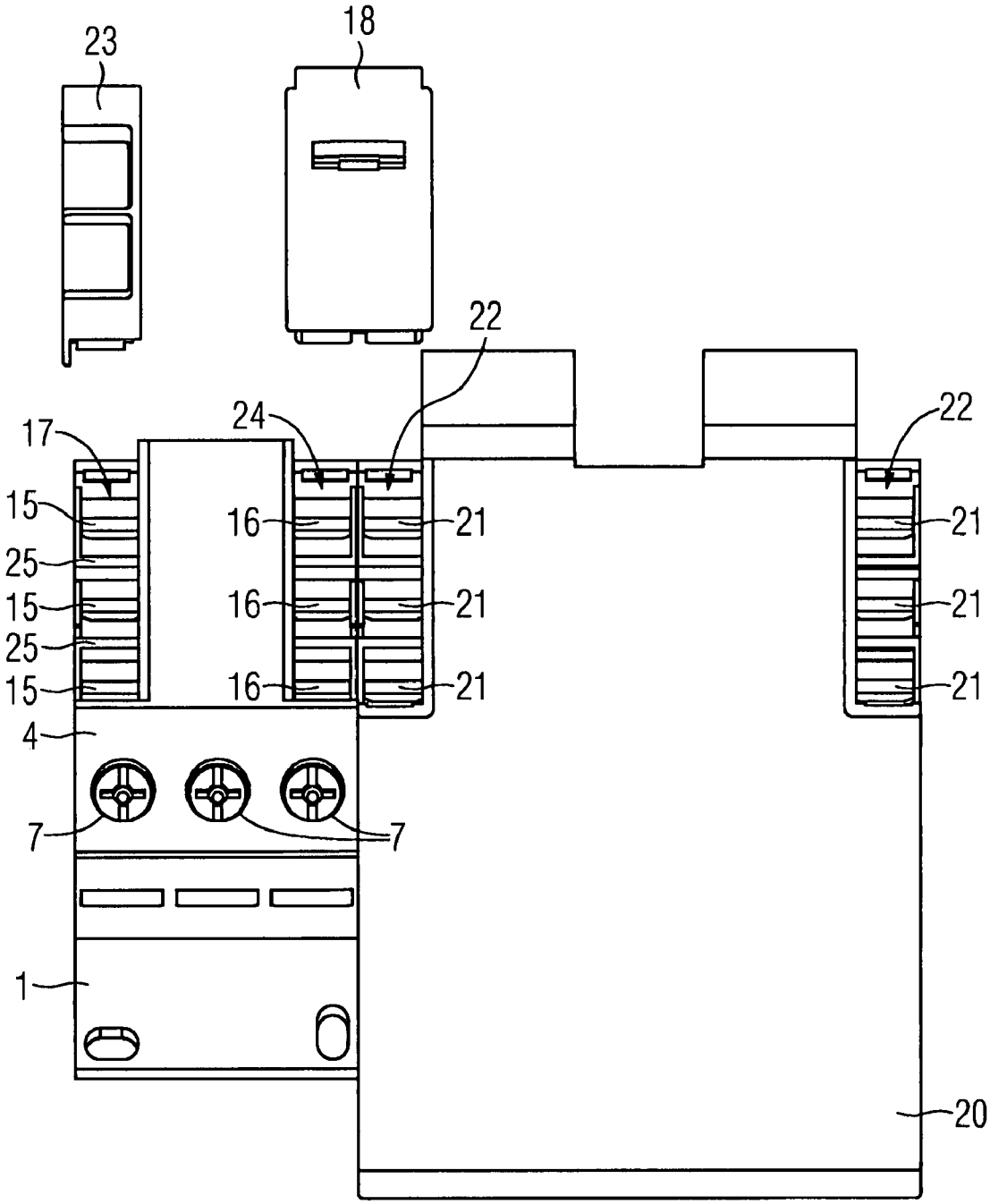
FIG. 4 shows a plan view of a switching device mount having a power distribution system, and having an electrical-power feed module which can be electrically connected to it.

Electrically conductive connections 14 as shown in FIG. 2 originate from the screw connecting terminals 5 and end in first 15 and/or second plug connections 16, which in this case are in the form of busbar sections (see also FIG. 4).

Figure 3:
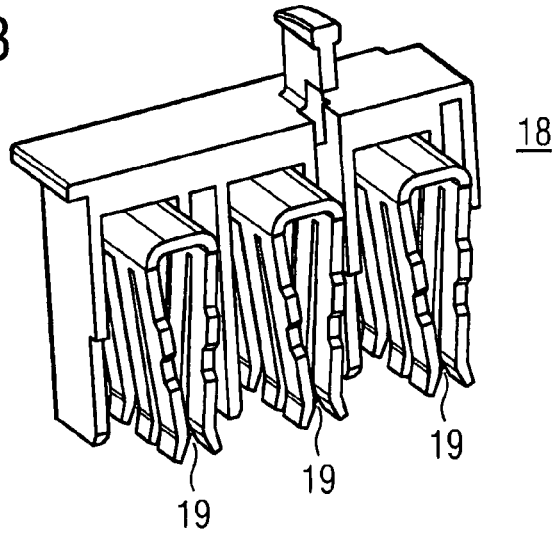
FIG. 3 shows a jumper plug for electrical connection of the electrical-power feed module to a polyphase power distribution system.

FIGS. 1 and 4 show the busbar sections 15, 16, which are separated from one another by insulating separating walls 25, are located in the interior of the housing 4, and are accessible via a first 17 and a second 24 contact-making opening 24 in the housing 4. A jumper plug 18 is provided in order to make electrical contact which is matched to the first 15 and to the second 16 plug connections, and by means of which the plug connections 15, 16 can be electrically connected to the polyphase power distribution system. As shown in FIG. 3, the jumper plug 18 is equipped with lyre contacts 19 as plug contacts for connection to the busbar sections 15, 16. In addition, the insulating housing of the jumper plug 18 is matched to the respective contact-making opening 17 or 24 in such a manner that this contact-making opening is covered by the jumper plug 18 once contact has been made with the plug connections 15 and 16, thus ensuring the necessary protection against direct contact.

FIG. 4 shows a plan view of the electrical-power feed module 1 having a mount 20 located alongside it, in a simplified form, in order to illustrate the features that are significant to the invention. Busbars 21 of a power distribution system are integrated in the mount 20. At each of the edges, the mount 20 has a contact-making opening 22, which is the same as the contact-making openings 17 and 24, respectively, in the electrical-power feed module 1. The jumper plug 18 allows an electrical plug connection to be made in a simple manner between the electrical-power feed module 1 and the power distribution system, that is to say the busbars 21. The electrical connection can be disconnected just as easily, just by withdrawing the jumper plug 18, at the same time resulting in the advantage that the isolation gap can be seen by the fitter. The plug connections which are not used by the fitter can be covered by appropriate covers 23, as shown in FIG. 4, as protection against direct contact. The fitter can subsequently safely access disconnected switching devices which have been adapted to the mount 20.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A polyphase, encapsulated electrical-power feed module, comprising:

a housing including, in its interior, connecting terminals electrically connected to first plug connections, used to make electrical contact with a polyphase power distribution system; and a jumper plug to make electrical contact, matched to the first plug connection, the first plug connections being electrically connected to the polyphase power distribution system via the jumper plug, wherein a first associated conductor insertion opening in the housing is included for each of the connecting terminals and wherein attachment means is provided for attachment of the electrical-power feed module, and wherein screw connecting terminals are additionally electrically connected to second plug connections, located in the interior of the housing and accessible via a second contact-making opening in the housing.

2. The polyphase, encapsulated electrical-power feed module as claimed in claim 1, wherein the screw connecting terminals are in the form of box terminals.

3. The polyphase, encapsulated electrical-power feed module as claimed in claim 1, wherein at least one of the first and second plug connections are in the form of busbar sections.

4. The polyphase, encapsulated electrical-power feed module as claimed in claim 1, wherein the jumper plug includes lyre contacts.

5. The polyphase, encapsulated electrical-power feed module as claimed in claim 1, wherein, once it has been firmly installed via its attachment means, the electrical-power feed module is electrically connected via the jumper plug to a power distribution system, and wherein the electrical connection is disconnectable by removal of the jumper plug.

6. The polyphase, encapsulated electrical-power feed module as claimed in claim 1, wherein the first plug connections are located in the interior of the housing and are accessible via a first contact-making opening in the housing.

7. The polyphase, encapsulated electrical-power feed module as claimed in claim 6, the jumper plug is matched to the first contact-making opening such that the first contact-making opening is closed by the jumper plug after contact with the first plug connections.

8. The polyphase, encapsulated electrical-power feed module as claimed in claim 1, wherein the busbar sections are separated from one another by insulating separating walls.

9. The polyphase, encapsulated electrical-power feed module as claimed in claim 8, wherein the power distribution system is accommodated in a mount, to which at least one switching device, which is connected to the power distribution system, is adapted.

10. The polyphase, encapsulated electrical-power feed module as claimed in claim 1, wherein the connecting terminal is in the form of a screw connecting terminal, including an associated access opening to a connecting screw in the housing.

11. The polyphase, encapsulated electrical-power feed module as claimed in claim 10, wherein the first plug connections are located in the interior of the housing and are accessible via a first contact-making opening in the housing.

12. The polyphase, encapsulated electrical-power feed module as claimed in claim 10, wherein the screw connecting terminals are in the form of box terminals.

13. The polyphase, encapsulated electrical-power feed module as claimed in claim 10, wherein at least one of the first and second plug connections are in the form of busbar sections.

14. The polyphase, encapsulated electrical-power feed module as claimed in claim 10, wherein the jumper plug includes lyre contacts.

15. The polyphase, encapsulated electrical-power feed module as claimed in claim 10, wherein the busbar sections are separated from one another by insulating separating walls.

16. The polyphase, encapsulated electrical-power feed module as claimed in claim 10, wherein, once it has been firmly installed via its attachment means, the electrical-power feed module is electrically connected via the jumper plug to a power distribution system, and wherein the electrical connection is disconnectable by removal of the jumper plug.

17. A polyphase, encapsulated electrical-power feed module, comprising:

a housing including, in its interior, connecting terminals electrically connected to first plug connections, used to make electrical contact with a polyphase power distribution system; and a jumper plug to make electrical contact, matched to the first plug connection, the first plug connections being electrically connected to the polyphase power distribution system via the jumper plug, wherein a first associated conductor insertion opening in the housing is included for each of the connecting terminals and wherein at least one attachment device is provided to attach the electrical-power feed module, and wherein screw connecting terminals are additionally electrically connected to second plug connections, located in the interior of the housing and accessible via a second contact-making opening in the housing.

18. The polyphase, encapsulated electrical-power feed module as claimed in claim 17, wherein the connecting terminal is in the form of a screw connecting terminal, including an associated access opening to a connecting screw in the housing.

19. The polyphase, encapsulated electrical-power feed module as claimed in claim 18, wherein, once it has been firmly installed via its at least one attachment device, the electrical-power feed module is electrically connected via the jumper plug to a power distribution system, and wherein the electrical connection is disconnectable by removal of the jumper plug.

* * * * *